US010833486B1

(12) United States Patent
Gozawa et al.

(10) Patent No.: US 10,833,486 B1
(45) Date of Patent: Nov. 10, 2020

(54) SPARK PLUG

(71) Applicant: NGK SPARK PLUG CO., LTD., Nagoya (JP)

(72) Inventors: Tatsuya Gozawa, Nagoya (JP); Kenji Ban, Nagoya (JP); Daiki Goto, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/814,126

(22) Filed: Mar. 10, 2020

(30) Foreign Application Priority Data

Apr. 19, 2019 (JP) ..... 2019-079757

(51) Int. Cl.
*H01T 13/32* (2006.01)
*H01T 13/54* (2006.01)
*H01T 13/39* (2006.01)

(52) U.S. Cl.
CPC ..... *H01T 13/32* (2013.01); *H01T 13/39* (2013.01); *H01T 13/54* (2013.01)

(58) Field of Classification Search
USPC ..... 123/169 EL
See application file for complete search history.

(56) References Cited

U.S. PATENT DOCUMENTS 9,397,482 B2 7/2016 Yamanaka
2012/0299459 A1* 11/2012 Sakakura ..... H01T 13/467 313/141
2015/0194793 A1 7/2015 Yamanaka
2016/0028214 A1* 1/2016 Mukoyama ..... H01T 13/54 313/139

FOREIGN PATENT DOCUMENTS

JP 2007-234511 A 9/2007
JP 2011-187437 A 9/2011
JP 2015-130302 A 7/2015
JP 2016-184558 A 10/2016
JP 2018-006304 A 1/2018

* cited by examiner

*Primary Examiner* — Ashok Patel
(74) *Attorney, Agent, or Firm* — Kusner & Jaffe

(57) ABSTRACT

A spark plug having excellent ignitability including a rod-shaped center electrode; a ground electrode that includes a facing portion facing a front end portion of the center electrode and forms a discharge gap between the facing portion and the front end portion of the center electrode; an insulator; a metal shell; and a cover portion that covers, from a front end side of the spark plug, the front end portion of the center electrode and the facing portion of the ground electrode to form a pre-chamber and includes injection holes that are through holes.

4 Claims, 7 Drawing Sheets

SPARK PLUG

FIELD OF THE INVENTION

The present invention relates to a spark plug.

BACKGROUND OF THE INVENTION

As spark plugs, the spark plugs disclosed in Japanese Unexamined Patent Application Publication No. 2007-234511 ("PTL 1"), Japanese Unexamined Patent Application Publication No. 2011-187437 ("PTL 2"), and Japanese Unexamined Patent Application Publication No. 2016-184558 ("PTL 3") are known. PTL 1 discloses a spark plug including a columnar center electrode and a ground electrode that has an end portion curved toward an inner peripheral side and that forms a spark discharge gap between a front end portion of the center electrode and the end portion. The spark plug is configured such that the axial line of the end portion of the ground electrode and the axial line of the center electrode are positioned to be skewed to each other. PTL 1 describes that such a configuration improves ignitability of the spark plug because, when a flame kernel formed in the spark discharge gap grows, the flame kernel can rapidly spread over the entirety of a combustion chamber without being obstructed by the end portion of the ground electrode in a direction toward the center of the combustion chamber.

In recent years, internal combustion engines are increasingly required to have high efficiency. It is known that improving combustion speed is effective to improve efficiency of internal combustion engines. A spark plug with a pre-chamber (hereinafter also referred to as the pre-chamber plug) has been attracting attention in recent years as being effective to improve combustion speed. See Japanese Unexamined Patent Application Publication No. 2015-130302 ("PTL 4") and Japanese Unexamined Patent Application Publication No. 2018-6304 ("PTL 5"). The pre-chamber plug has been applied to power generators and engines for races, and an improvement of combustion efficiency has been confirmed. Further, even when applied to internal combustion engines other than power generators and engines for races, the pre-chamber plug is effective to improve combustion efficiency.

In pre-chamber plugs, after ignition of a spark between electrodes, combustion first occurs in a pre-chamber. Then, flame of the combustion in the pre-chamber is injected out via through holes (injection holes) that are in communication with the outside, and the injected high-temperature gas as an ignition source causes explosive combustion in a main combustion chamber. The speed of injection of the high-temperature gas from the pre-chamber is higher than that of combustion caused by ignition of a spark plug without a pre-chamber. Moreover, the entire trail of the injected high-temperature gas serves as an ignition source. Therefore, it is possible to cause a larger amount of fuel to be brought into contact with the high-temperature gas. Thus, the combustion speed of pre-chamber plug is higher than the combustion speed of spark plug without a pre-chamber, and therefore, the effect of improving combustion efficiency can be expected.

Incidentally, it is known that a flow is constantly present in the main combustion chamber, and the state of the flow greatly differs depending on a difference in a position in the main combustion chamber, such as an intake side and an exhaust side. In other words, depending on the state of the flow in each portion in the main combustion chamber, there is a difference in ignitability of each portion. In the pre-chamber plug, however, the strength of injection from a plurality of injection holes is generally equal among the injection holes. Such a configuration is not capable of responding to a layout in accordance with ignitability of each portion in the main combustion chamber, and has a room for improvement from the point of view of ignitability.

SUMMARY OF THE INVENTION

The present invention was developed in consideration of the aforementioned circumstances, and an object of the present invention is to provide a spark plug having excellent ignitability. The present invention can be embodied as the following forms.

A spark plug according to the present invention includes:

a rod-shaped center electrode;

a ground electrode that includes a facing portion facing a front end portion of the center electrode and forms a discharge gap between the facing portion and the front end portion of the center electrode;

a cylindrical insulator that accommodates the center electrode therein with the front end portion of the center electrode being exposed from a front end of the insulator;

a cylindrical metal shell that accommodates the insulator therein; and a cover portion that covers, from a front end side of the spark plug, the front end portion of the center electrode and the facing portion of the ground electrode to form a pre-chamber, the cover portion including at least one injection hole that is a through hole, wherein the facing portion includes a proximity portion that is closest to the front end portion of the center electrode, the proximity portion being positioned in a virtual space that is an inside of a cylindrical shape formed by extending an outer periphery of the front end portion of the center electrode in a direction of an axial line of the center electrode, and wherein a middle point of a shortest line segment connecting the front end portion of the center electrode and the proximity portion of the facing portion is positioned being displaced from the axial line of the center electrode.

According to this configuration, it is possible to provide a spark plug having excellent ignitability by locating a middle point of a shortest straight line connecting the front end portion of the center electrode and the proximity portion of the facing portion so as to be displaced from the axial line of the center electrode and thereby adjusting the injection strength from the injection hole.

The aforementioned spark plug may be configured such that the pre-chamber includes, in an inner wall surface thereof, an opening portion into which a base end portion of the ground electrode is inserted, and when the pre-chamber is divided into a first part and a second part along a plane including a center of the opening portion and the axial line of the center electrode, the at least one injection hole is present in each of the first part and the second part.

According to this configuration, it is possible to vary the injection strength between the injection hole present in the first part and the injection hole present in the second part in accordance with the position of the middle point of the shortest straight line connecting the front end portion of the center electrode and the proximity portion of the facing portion and arrangement of the ground electrode. Therefore, it is possible to enhance ignitability by designing arrangement of the first part and the second part in accordance with, for example, a layout in the main combustion chamber.

In the aforementioned spark plug, the facing portion may be present on the axial line of the center electrode.

According to this configuration, it is possible to sufficiently ensure the size of the facing portion, with the result that wear resistance of the facing portion can be improved.

DETAILED DESCRIPTION OF THE INVENTION

First Embodiment

Figure 1:
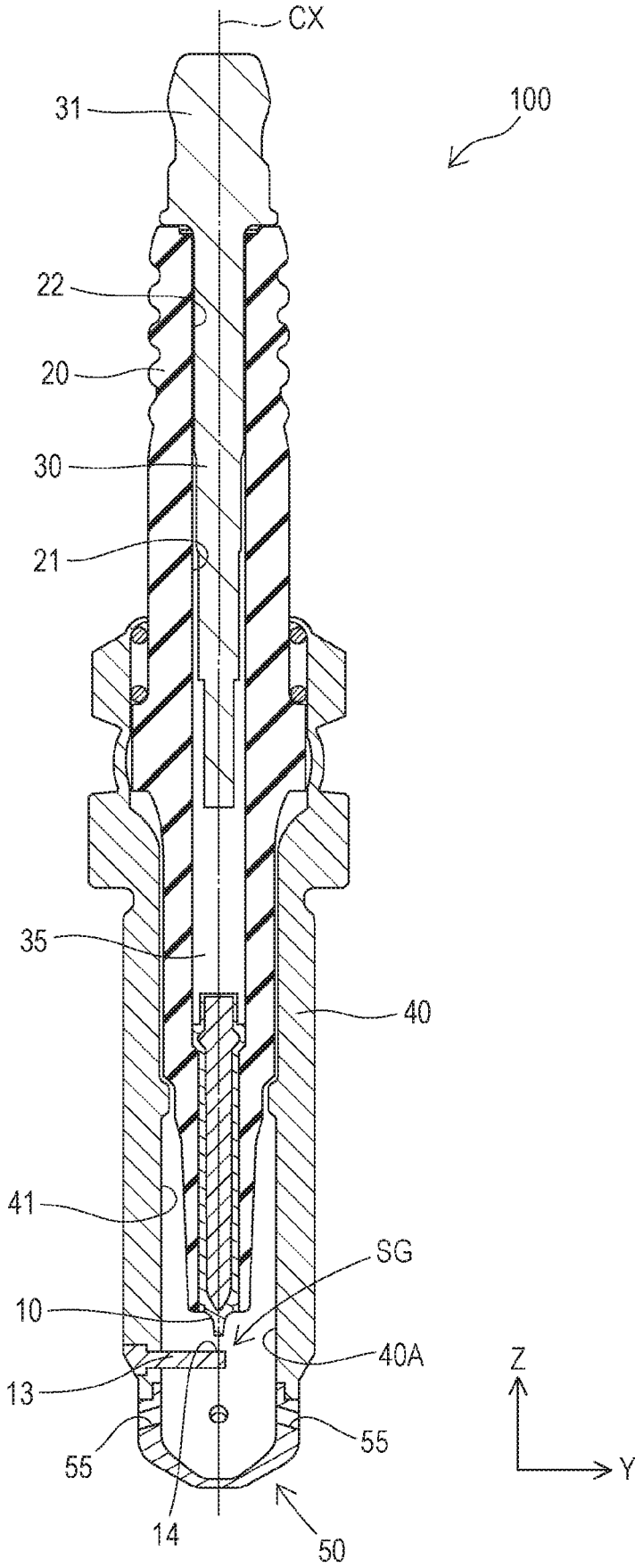
FIG. 1 is a sectional view illustrating a structure of a spark plug according to a first embodiment.
Figure 2:
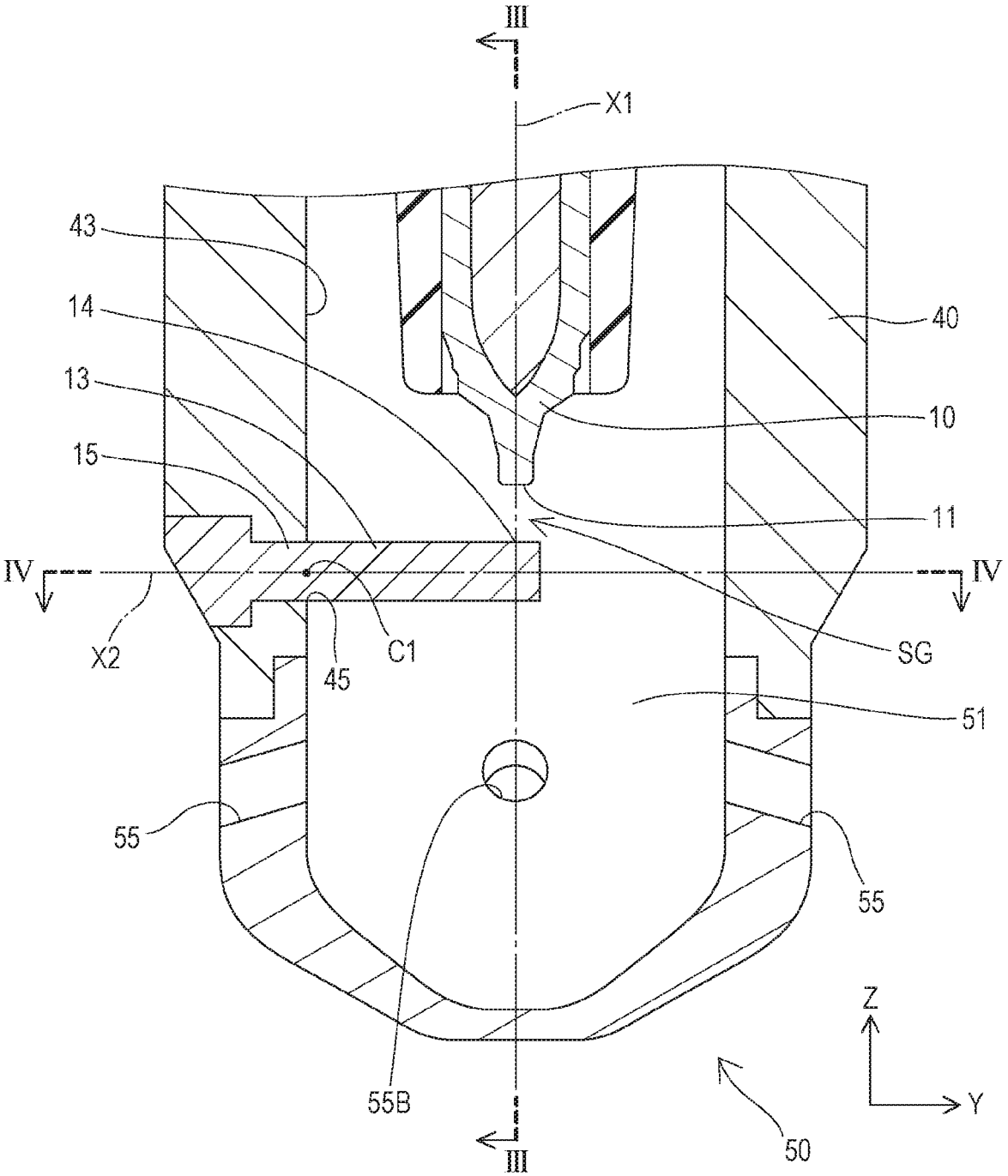
FIG. 2 is a partial enlarged sectional view of the spark plug.
Figure 3:
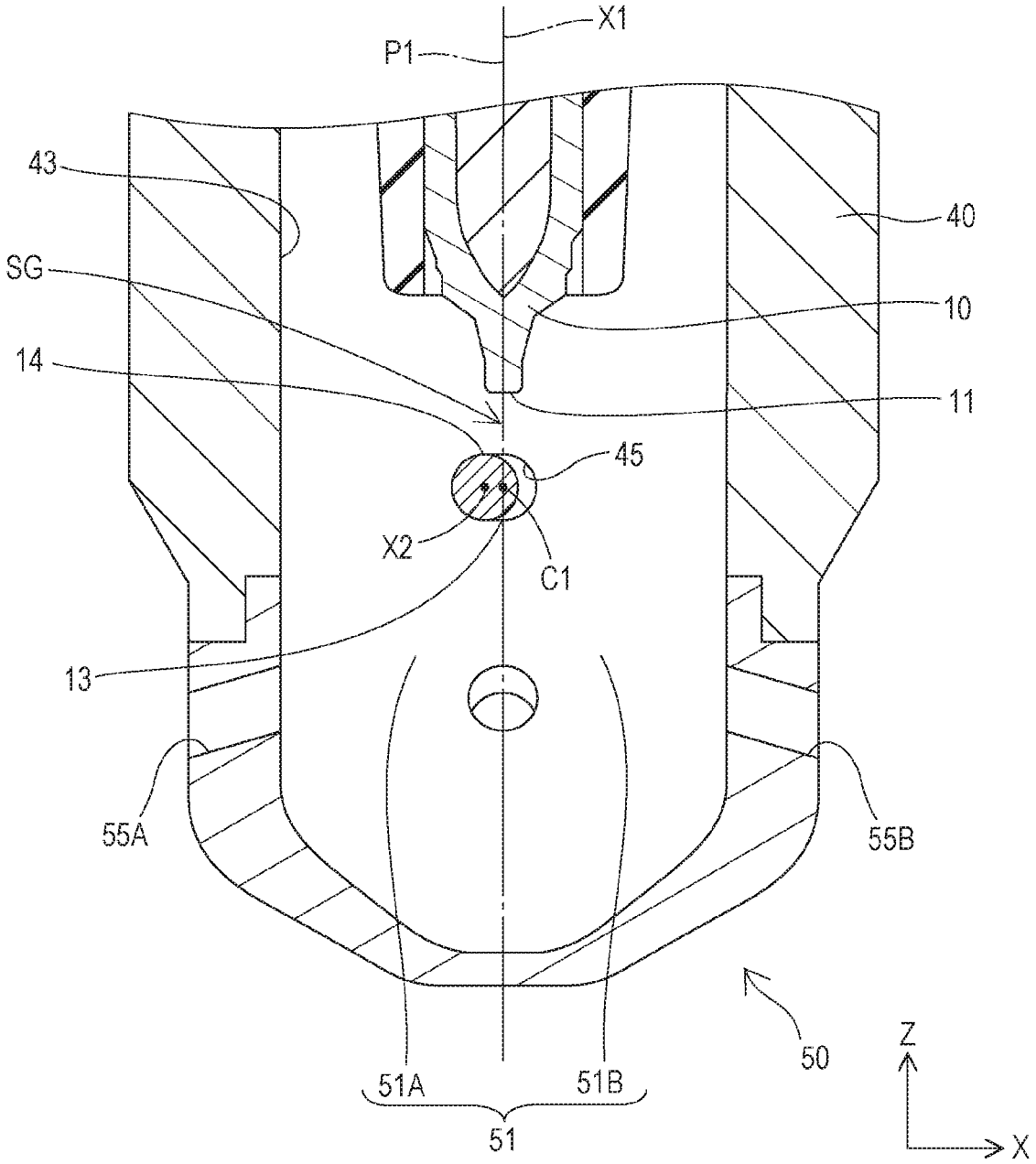
FIG. 3 is a partial enlarged sectional view of the spark plug, taken along line III-III of FIG. 2.

Hereinafter, a first embodiment of a spark plug 100 will be described in detail with reference to the drawings. In the following description, the lower side of FIG. 1 is a front end side (front side) of the spark plug 100, the upper side of FIG. 1 is a rear end side, and an up-down direction is a Z-axis direction. The left-right direction of FIG. 2 is a Y-axis direction of the spark plug 100, and the left-right direction of FIG. 3 is an X-axis direction of the spark plug 100.

FIG. 1 is a sectional view illustrating an outline of a configuration of the spark plug 100 in the first embodiment.

Figure 6:
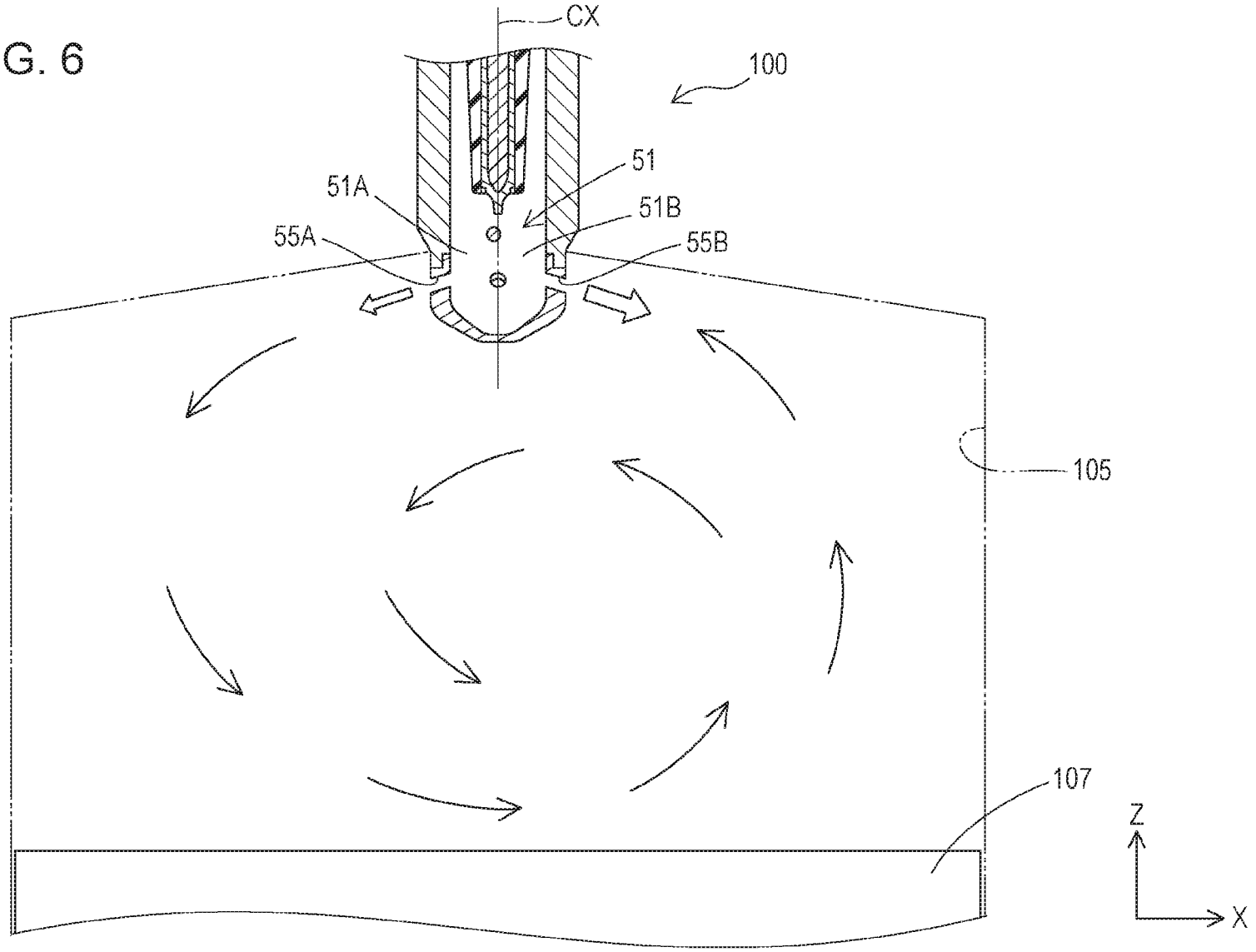
FIG. 6 is a sectional view illustrating a state in which the spark plug is disposed in an internal combustion engine.

In FIG. 1, a center axial line CX of the spark plug 100 is indicated by a one-dot chain line. In FIG. 6, a ceiling surface and a side wall surface of a combustion chamber 105 when the spark plug 100 is mounted on an internal combustion engine are indicated by two-dot chain lines. A piston 107 is disposed in the combustion chamber 105.

The spark plug 100 is mounted on an internal combustion engine and used for ignition thereof. When mounted on the internal combustion engine, the front end side of the spark plug 100 (lower side in FIG. 6) is disposed inside the combustion chamber 105 of the internal combustion engine and the rear end side thereof (upper side in FIG. 6) is disposed outside the combustion chamber 105. As illustrated in FIG. 1, the spark plug 100 includes a center electrode 10, a ground electrode 13, an insulator 20, a terminal electrode 30, a metal shell 40, and a cover portion 50.

The center electrode 10 is constituted by a rod-shaped electrode member and disposed in such a manner that an axial line X1 thereof is coincident with the center axial line CX of the spark plug 100. The center electrode 10 is held by the metal shell 40 with the insulator 20 interposed therebetween in such a manner that a front end portion 11 of the center electrode 10 is positioned in a front-end-side opening portion 40A of the metal shell 40. The center electrode 10 is electrically connected to an external power source via the terminal electrode 30 disposed on the rear end side.

The ground electrode 13 is a rod-shaped electrode extending toward the front end portion 11 of the center electrode 10. The ground electrode 13 extends from an inner peripheral surface 43 toward the inner side in the front-end-side opening portion 40A of the metal shell 40. The ground electrode 13 extends up to the front of the front end portion 11 of the center electrode 10. The ground electrode 13 includes a facing portion 14 facing the front end portion 11 of the center electrode 10. A discharge gap SG is formed between the facing portion 14 of the ground electrode 13 and the front end portion 11 of the center electrode 10. A configuration of arrangement of the ground electrode 13 will be described later.

The insulator 20 is a cylindrical member including an axial hole 21 penetrating through the center thereof. The insulator 20 is constituted by, for example, a ceramic sintered body made of alumina or aluminum nitride. On the front end side of the axial hole 21 of the insulator 20, the center electrode 10 is accommodated with the front end portion 11 thereof being exposed. On the rear end side of the axial hole 21, the terminal electrode 30, which is a shaft-shaped electrode member, is held. A rear end portion 31 of the terminal electrode 30 extends out from a rear end opening portion 22 of the insulator 20 so as to be connectable with the external power source. The center electrode 10 and the terminal electrode 30 are electrically connected to each other via a resistor 35 that is held between glass sealing materials in order to suppress generation of radio interference noise when a spark discharge occurs. The center axis of the insulator 20 is coincident with the center axial line CX of the spark plug 100.

The metal shell 40 is a substantially cylindrical metal member including a cylinder hole 41 at the center thereof and accommodates the insulator 20 therein. The metal shell 40 is constituted of, for example, carbon steel. The center axis of the metal shell 40 is coincident with the center axial line CX of the spark plug 100. As described above, the ground electrode 13 is mounted in the front-end-side opening portion 40A of the metal shell 40.

As illustrated in FIG. 2 and FIG. 3, the inner peripheral surface 43 of the metal shell 40 constitutes a part of an inner wall surface of a pre-chamber 51. The metal shell 40 includes, in the inner peripheral surface 43, an opening portion 45 into which a base end portion 15 of the ground electrode 13 is inserted. The opening portion 45 is an inner peripheral-side opening of a through hole penetrating through the metal shell 40 in an inside-outside direction. The through hole is configured to enable the ground electrode 13 to be inserted thereinto from the outer peripheral side toward the inner peripheral side of the metal shell 40.

The cover portion 50 has a dome shape. The rear end of the cover portion 50 is fixed to the front end of the metal shell 40. The cover portion 50 covers, from the front end side, the front end portion 11 of the center electrode 10 and the facing portion 14 of the ground electrode 13 to form the pre-chamber 51. In other words, the pre-chamber 51 is a space surrounded by the inner wall surface of the cover portion 50 and the inner peripheral surface 43 of the metal shell 40. The cover portion 50 includes injection holes 55 as through holes. The pre-chamber 51 (ignition chamber), which is a space covered by the cover portion 50, is in communication with the combustion chamber 105 via the injection holes 55. A portion of the cover portion 50 on the front end side with respect to the injection holes 55 is thinner than a portion of the cover portion 50 on the rear end side with respect to the injection holes 55.

Figure 4:
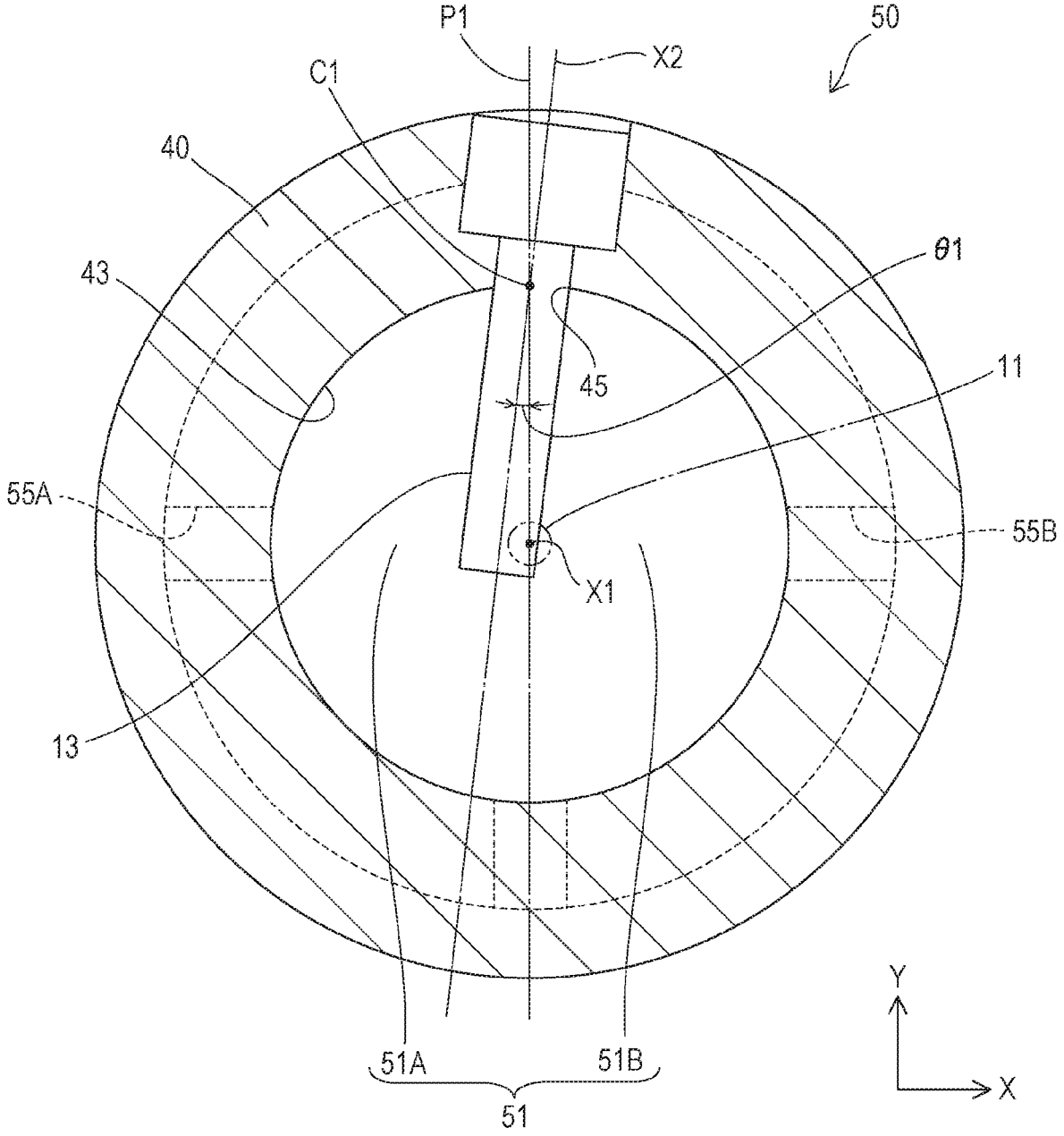
FIG. 4 is a sectional view of the spark plug, taken along line IV-IV of FIG. 2.

The cover portion 50 includes, in the pre-chamber 51, a plurality of the injection holes 55 formed on the front end side with respect to the discharge gap SG. The plurality of injection holes 55 is positioned on a virtual circumference centered on the axial line X1 of the center electrode 10 (refer to FIG. 4). Specifically, four injection holes 55 are arranged at equal intervals on the circumference of a virtual circle centered on the axial line X1 of the center electrode 10. In FIG. 4, supposing that a center C1 of the opening portion 45 is 0° with a counter-clockwise rotation as positive, the injection holes 55 are disposed one each at the positions of 0°, 90°, 180°, and 270°. In other words, the injection holes 55 are disposed symmetrically to each other in the left-right direction with respect to a plane P1 that includes the center C1 of the opening portion 45 and the axial line X1 of the center electrode 10. In FIG. 4, the injection hole 55 at the position of 0° is not illustrated. In the following description, the injection hole 55 disposed at the position of 90° on the left side of FIG. 4 is referred to as an injection hole 55A, and the injection hole 55 disposed at the position of 270° on the right side is referred to as an injection hole 55B.

Next, a configuration of arrangement of the ground electrode 13 will be described.

As illustrated in FIG. 2 and FIG. 3, only one ground electrode 13 is provided in the spark plug 100. The ground electrode 13 has a circular sectional shape and extends linearly. The base end portion 15 of the ground electrode 13 is inserted into the opening portion 45 of the metal shell 40. The ground electrode 13 is held so as to extend from the inner peripheral surface 43 of the metal shell 40 in a cantilever manner with the base end portion 15 inserted in the opening portion 45. The ground electrode 13 projects toward the inner side from a portion of the inner wall surface of the pre-chamber 51 positioned on the upper side with respect to the plurality of injection holes 55, and occupies a portion of a space of the pre-chamber 51 on the upper side with respect to the plurality of injection holes 55. The ground electrode 13 projects in the pre-chamber 51 in such a manner that an axial line X2 thereof is positioned to be skewed to the axial line X1 of the center electrode 10. As illustrated in FIG. 4, in a cross-section taken along a plane passing the axial line X2 of the ground electrode 13 and perpendicular to the axial line X1 of the center electrode 10, the ground electrode 13 is offset by an angle θ1 in the X-axis direction with respect to a reference line passing the center C1 of the opening portion 45 and the axial line X1 of the center electrode 10.

The ground electrode 13 is interposed between the injection hole 55A and the discharge gap SG. In other words, the ground electrode 13 is disposed in the pre-chamber 51 so as to cover the discharge gap SG from the side of the injection hole 55A. The ground electrode 13 can be an obstacle when a flame spreads from the discharge gap SG toward the injection hole 55A. The ground electrode 13 also can be an obstacle when a flame spreads from the discharge gap SG toward the injection hole 55B; however, it is configured such that the degree of obstruction is smaller than that when the flame spreads toward the injection hole 55A. For example, the ground electrode 13 is configured not to be interposed between the injection hole 55B and the discharge gap SG.

Figure 5:
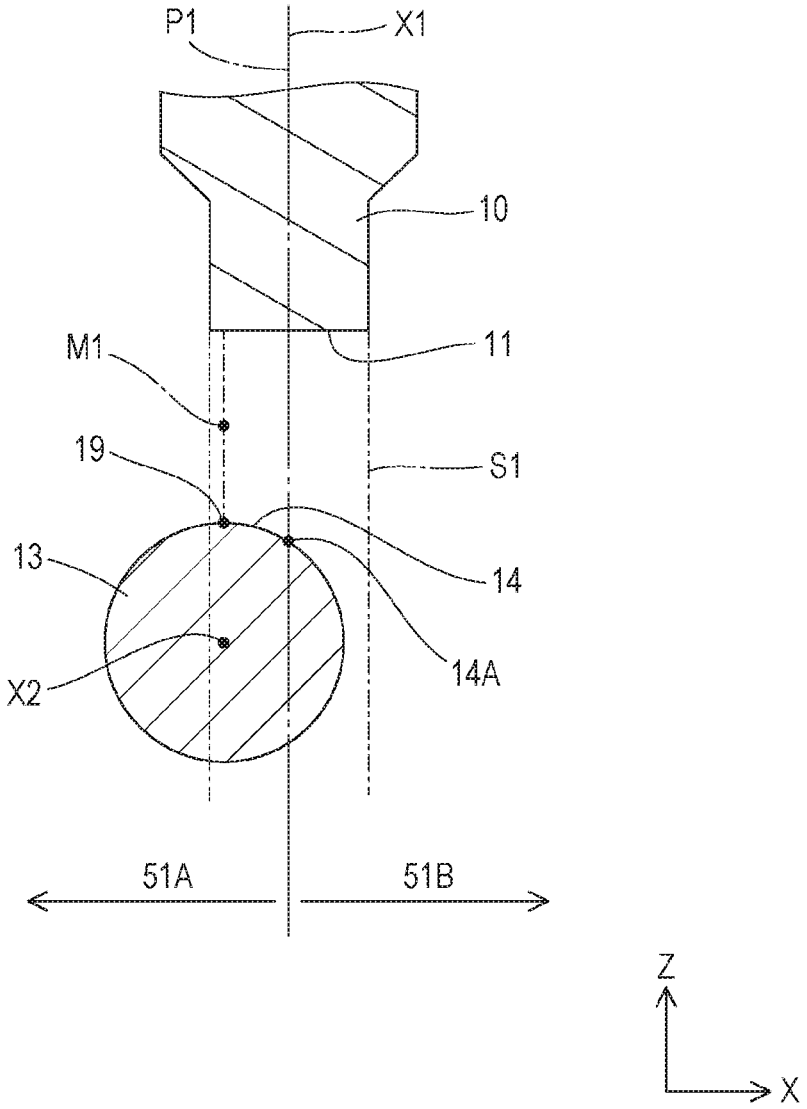
FIG. 5 is a schematic view of a front end portion of a center electrode and a proximity portion of a facing portion.

As illustrated in FIG. 5, a proximity portion 19 of the facing portion 14 that is closest to the front end portion 11 of the center electrode 10 is positioned in a virtual space S1 that is an inside of a cylindrical shape formed by extending the outer periphery of the front end portion 11 of the center electrode 10 in the direction of the axial line X1 of the center electrode 10. The proximity portion 19 is a portion that is determined in the facing portion 14 according to the shape and the position of each of the front end portion 11 of the center electrode 10 and the facing portion 14. In the present embodiment, since the front end portion 11 of the center electrode 10 is a flat surface perpendicular to the axial line X1 and the facing portion 14 is a side surface of a circular column, the proximity portion 19 is uniquely determined. A middle point M1 of the shortest line segment connecting the front end portion 11 of the center electrode 10 and the proximity portion 19 of the facing portion 14 is positioned being displaced from the axial line X1 of the center electrode 10. The middle point M1 is a point where a flame kernel is formed in the discharge gap SG. As with a case in which the front end portion of the center electrode and the facing portion have surfaces parallel to each other, when a plurality of shortest line segments connecting the front end portion of the center electrode and the proximity portion of the facing portion can be defined, middle points of all of the line segments defined may satisfy the aforementioned requirements.

The facing portion 14 is present on the axial line X1 of the center electrode 10. FIG. 5 is a sectional view taken along a plane that is perpendicular to the axial line X2 of the ground electrode 13 and that includes the center axial line CX. In FIG. 5, a portion 14A of the facing portion 14 is positioned on the axial line X1 of the center electrode 10. The portion 14A is positioned on the front end side with respect to the proximity portion 19.

As illustrated in FIG. 3 and FIG. 4, in the spark plug 100, when the pre-chamber 51 is divided into a first part 51A and a second part 51B along the plane P1 including the center C1 of the opening portion 45 and the axial line X1 of the center electrode 10, at least one of the injection holes 55 is present in each of the first part 51A and the second part 51B. The injection hole 55 present in the first part 51A is the injection hole 55A, and the injection hole 55 present in the second part 51B is the injection hole 55B. In other words, when the plane P1 is specified as a Y-Z plane, the injection hole 55A and the injection hole 55B are present on both sides in the X-axis direction. The number of the injection holes 55 present in the first part 51A and the second part 51B is counted by ignoring the injection holes 55 disposed across the first part 51A and the second part 51B.

Next, effects of the present embodiment will be described with reference to FIG. 6.

As illustrated in FIG. 6, in the combustion chamber 105, for example, a flow such as that indicated by solid-line arrows is generated. In the vicinity of the spark plug 100, a flow from the right side to the left side of FIG. 6 is generated. In other words, the combustion chamber 105 has a layout in which, with respect to the spark plug 100, a flow in a direction identical to a direction of flame injected from the injection hole 55A is generated on the left side of FIG. 6 and a flow in a direction opposite to a direction of flame injected from the injection hole 55B is generated on the right side of FIG. 6.

In the spark plug 100, the middle point M1 of the shortest line segment connecting the front end portion 11 of the center electrode 10 and the proximity portion 19 of the facing portion 14 is positioned being displaced from the axial line X1 of the center electrode 10 toward the left side of FIG. 6. When electric discharge occurs between the center electrode 10 and the ground electrode 13 and a flame kernel is formed at the middle point M1, combustion occurs in the pre-chamber 51. Flame of the combustion in the pre-chamber 51 is injected through the plurality of injection holes 55 into the combustion chamber 105. At this time, the ground electrode 13 acts as a structure that causes a pressure loss when the flame spreads in the pre-chamber 51. When the flame spreads in the first part 51A of the pre-chamber 51, a pressure loss is generated due to the ground electrode 13 interposed between the middle point M1 and the injection hole 55A. In contrast, when the flame spreads in the second part 51B of the pre-chamber 51, a pressure loss is less likely to be generated because the ground electrode 13 is not interposed between the middle point M1 and the injection hole 55B or only a slight portion thereof is interposed therebetween. Therefore, in the spark plug 100, the injection strength of flame injected from the injection hole 55A is small, and the injection strength of flame injected from the injection hole 55B is large. In FIG. 6, flame injected from the injection hole 55A is schematically indicated by a small outlined arrow, and flame injected from the injection hole 55B is schematically indicated by a large outlined arrow. The flame injected from the injection hole 55A reaches the vicinity of the left-side side wall surface of the combustion chamber 105 by moving along the flow. The flame injected from the injection hole 55B reaches the vicinity of the right-side side wall surface of the combustion chamber 105 by moving against the flow. In the combustion chamber 105, the entirety of the trail of the flame injected from the injection holes 55A and 55B serves as an ignition source, so that combustion occurs efficiently.

As described above, according to the present embodiment, it is possible to provide a spark plug having excellent ignitability by locating the middle point M1 of the shortest straight line connecting the front end portion 11 of the center electrode 10 and the proximity portion 19 of the facing portion 14 so as to be displaced from the axial line X1 of the center electrode 10 and thereby adjusting the strength of injection from the injection holes 55A and 55B.

Further, according to the present embodiment, it is possible to vary the injection strength between the injection hole 55A present in the first part 51A and the injection hole 55B present in the second part 51B in accordance with the position of the middle point M1 of the shortest straight line connecting the front end portion 11 of the center electrode 10 and the proximity portion 19 of the facing portion 14. Therefore, it is possible to enhance ignitability by designing arrangement of the first part 51A and the second part 51B in accordance with, for example, the layout in the combustion chamber 105.

In the present embodiment, the facing portion 14 is present on the axial line X1 of the center electrode 10. Thus, it is possible to sufficiently ensure the size of the facing portion 14, with the result that wear resistance of the facing portion 14 can be improved.

Different Embodiment (Modification)

The present invention is not limited to the aforementioned embodiment and can be embodied in various forms within a range thereof.

Figure 7:
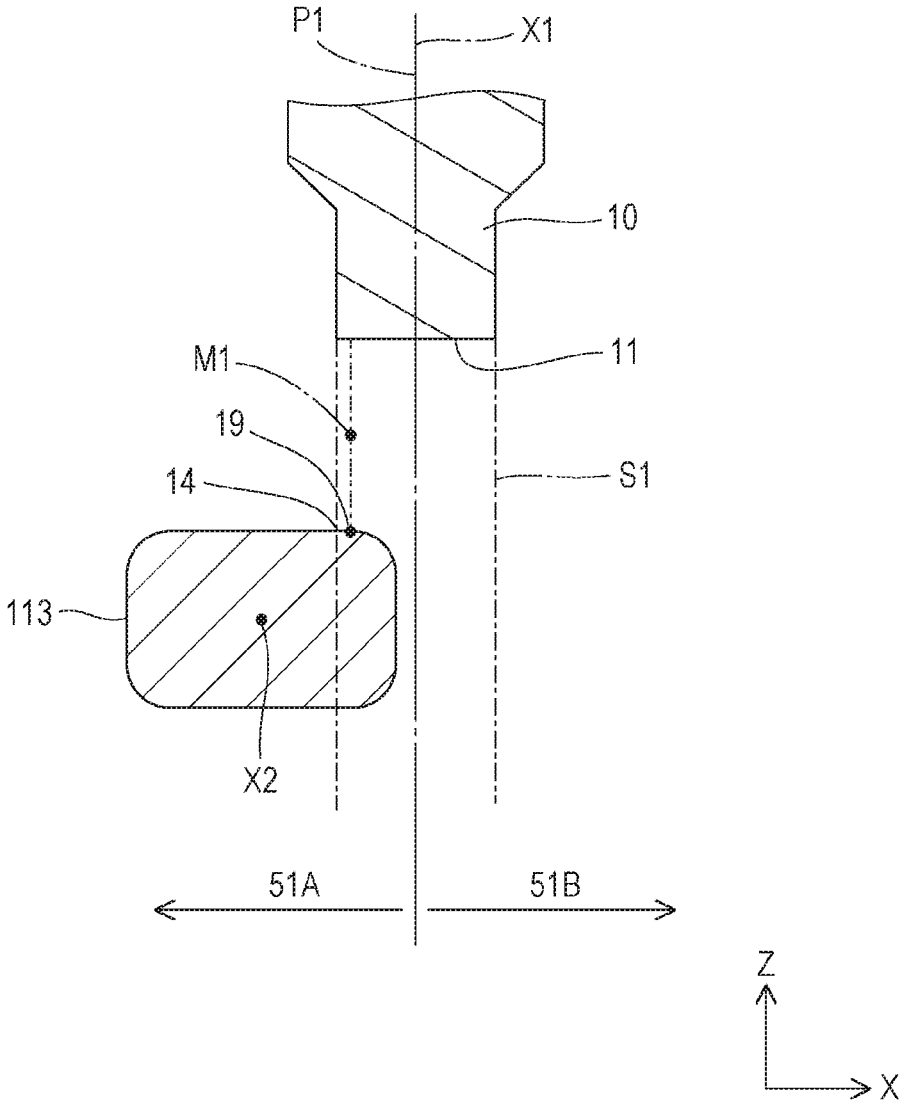
FIG. 7 is a schematic view of the front end portion of the center electrode and the proximity portion of the facing portion in a different embodiment.

(1) In the aforementioned embodiment, a configuration in which the ground electrode has a circular columnar shape is presented as an example; however, it is not limited thereto. For example, a configuration in which, as with a ground electrode 113 illustrated in FIG. 7, the ground electrode has a substantially rectangular columnar shape may be employed. In the aforementioned embodiment, a configuration in which the facing portion is present on the axial line of the center electrode is presented as an example; however, as with the ground electrode 113, the facing portion 14 may be present on the axial line X1 of the center electrode 10. The ground electrode is not limited to extending linearly and may be bent and extend.

(2) In the aforementioned embodiment, a configuration in which the ground electrode 13 is not interposed between the injection hole 55B and the discharge gap SG is presented as an example; however, it is not limited thereto. For example, the ground electrode 13 may be disposed such that a region range interposed between the injection hole 55B and the discharge gap SG is smaller than a region range interposed between the injection hole 55A and the discharge gap SG.

(3) In the aforementioned embodiment, a configuration in which the metal shell includes an opening portion into which the base end portion of the ground electrode is inserted is presented as an example; however, it is not limited thereto. For example, a configuration in which the cover portion includes an opening portion may be employed.

(4) Other than the aforementioned embodiment, the number, the arrangement, and the penetrating direction of the injection holes can be changed, as appropriate. For example, each of the injection holes present in the first part and the second part may be disposed at a position at any angle when the center of the opening portion is 0°. In the aforementioned embodiment, a configuration in which the injection holes are disposed symmetrically in the left-right direction with respect to a plane that includes the center of the opening portion and the axial line of the center electrode is present as an example; however, it is not limited thereto.

(5) In the aforementioned embodiment, the shape of the cover portion is a specific shape; however, the shape can be changed, as appropriate. The shape of the cover portion can be, for example, a circular cylindrical shape, a quadrangular box shape, or a conical shape.

(6) The layout of the spark plug in the combustion chamber can be changed, as appropriate, other than that in the aforementioned embodiment.

What is claimed is:

1. A spark plug, comprising:

a rod-shaped center electrode extending along an axial line, the center electrode having a front end portion, the front end portion having an outer periphery;

a ground electrode having a facing portion, the facing portion facing the front end portion of the center electrode, the facing portion being positioned to form a discharge gap with the front end portion of the center electrode, the facing portion including a proximity portion that is closest to the front end portion of the center electrode, the proximity portion being positioned in a virtual space that is an inside of a cylindrical shape formed by extending the outer periphery of the front end portion of the center electrode in a direction of the axial line of the center electrode;

a cylindrical insulator having a front end, the cylindrical insulator accommodating the center electrode therein with the front end portion of the center electrode being exposed from the front end of the insulator;

a cylindrical metal shell that accommodates the insulator therein; and a cover portion that covers the front end portion of the center electrode and the facing portion of the ground electrode to form a pre-chamber, the cover portion including at least one injection hole that is a through hole, wherein a middle point of a shortest line segment connecting the front end portion of the center electrode and the proximity portion of the facing portion is displaced from the axial line of the center electrode.

2. The spark plug according to claim 1, wherein the ground electrode includes a base end portion, wherein the pre-chamber includes an inner wall surface and an opening portion in the inner wall surface into which the base end portion of the ground electrode is inserted, and wherein, when the pre-chamber is divided into a first part and a second part along a plane including a center of the opening portion and the axial line of the center electrode, the at least one injection hole is present in each of the first part and the second part.

3. The spark plug according to claim 1, wherein the facing portion is present on the axial line of the center electrode.

4. The spark plug according to claim 2, wherein the facing portion is present on the axial line of the center electrode.

* * * * *